US009655403B2

(12) United States Patent
Farris

(10) Patent No.: US 9,655,403 B2
(45) Date of Patent: May 23, 2017

(54) OUTSOLE WITH STEPPED PROJECTIONS FOR ARTICLE OF FOOTWEAR

(71) Applicant: NIKE, Inc., Beaverton, OH (US)

(72) Inventor: Bryan N. Farris, North Plains, OR (US)

(73) Assignee: NIKE, Inc., Beaverton, OR (US)

( * ) Notice: Subject to any disclaimer, the term of this patent is extended or adjusted under 35 U.S.C. 154(b) by 212 days.

(21) Appl. No.: 14/025,351

(22) Filed: Sep. 12, 2013

(65) Prior Publication Data

US 2015/0068063 A1 Mar. 12, 2015
US 2015/0342298 A9 Dec. 3, 2015

(51) Int. Cl.

| | |
|---|---|
| ***A43B 13/00*** | (2006.01) |
| ***A43B 13/22*** | (2006.01) |
| ***A43B 13/18*** | (2006.01) |
| ***A43B 7/14*** | (2006.01) |
| ***A43C 15/16*** | (2006.01) |

(52) U.S. Cl.

CPC ..... *A43B 13/22* (2013.01); *A43B 7/146* (2013.01); *A43B 13/18* (2013.01); *A43B 13/223* (2013.01); *A43C 15/162* (2013.01); *A43C 15/168* (2013.01)

(58) Field of Classification Search

CPC ... A43B 13/223; A43B 13/122; A43B 13/184; A43B 13/141; A43B 13/143; A43B 13/26; A43B 13/18; A43B 13/22; A43B 7/146; A43B 15/168; A43B 15/162

USPC ..... 36/103, 102, 117.3, 3 B, 59 C, 126, 88, 36/97, 93, 116, 134, 59 R, 25 R, 43, 28

See application file for complete search history.

(56) References Cited

U.S. PATENT DOCUMENTS 2,722,756 A * 11/1955 Ecclesine ..... A43B 13/223 36/32 R
3,006,085 A * 10/1961 Bingham, Jr. ..... A43B 13/223 36/59 C
4,040,192 A 8/1977 Perez
4,241,524 A * 12/1980 Sink ..... 36/102
4,309,831 A * 1/1982 Pritt ..... A43B 7/06 36/3 B (Continued)

FOREIGN PATENT DOCUMENTS

DE 3127793 C1 1/1983
EP 1557104 A1 7/2005

OTHER PUBLICATIONS

Utility U.S. Appl. No. 14/025,394, filed Sep. 12, 2013.

(Continued)

*Primary Examiner* — Anna Kinsaul
*Assistant Examiner* — Jillian K Pierorazio
(74) *Attorney, Agent, or Firm* — Banner & Witcoff, Ltd.

(57) ABSTRACT

An article of footwear includes an outsole having a base with an upper surface that faces the upper and a lower surface that faces away from the upper surface. The outsole also includes a first stepped projection that projects in a plurality of first steps from the lower surface. The plurality of first steps is defined by a plurality of first tread surfaces and a plurality of first riser surfaces. The outsole additionally includes a second stepped projection that projects in a plurality of second steps from the lower surface. The plurality of second steps is defined by a plurality of second tread surfaces and a plurality of second riser surfaces. The second stepped projection is spaced away from the first stepped projection relative to the lateral axis of the article of footwear.

24 Claims, 7 Drawing Sheets

(56) References Cited

U.S. PATENT DOCUMENTS 4,378,643 A * 4/1983 Johnson ..... A43B 13/223 36/129
4,404,759 A * 9/1983 Dassler ..... A43B 5/06 36/129
4,439,936 A * 4/1984 Clarke ..... A43B 5/06 36/102
4,498,251 A * 2/1985 Shin ..... A43B 5/06 36/30 R
4,658,514 A * 4/1987 Shin ..... A43B 5/06 36/30 R
4,689,901 A * 9/1987 Ihlenburg ..... 36/126
4,741,114 A * 5/1988 Stubblefield ..... A43B 13/146 36/114
4,769,928 A * 9/1988 Ward ..... A43B 5/00 36/114
4,802,289 A 2/1989 Guldager
5,313,718 A * 5/1994 McMahon ..... A43B 13/26 36/114
5,694,706 A 12/1997 Penka
6,076,283 A * 6/2000 Boie ..... A43B 3/0057 36/114
6,705,027 B1 * 3/2004 Campbell ..... A43B 5/001 36/127
7,287,343 B2 * 10/2007 Healy ..... A43B 13/223 36/134
7,313,875 B2 * 1/2008 Morgan ..... A43B 13/145 36/25 R
7,543,399 B2 6/2009 Kilgore et al.
D616,187 S * 5/2010 Moon ..... D2/951
D622,946 S * 9/2010 Moon ..... D2/951
8,322,050 B2 * 12/2012 Lubart ..... A43B 13/223 36/59 C
8,555,528 B2 * 10/2013 Gerber ..... A43B 13/26 36/128
8,578,630 B2 * 11/2013 Diepenbrock ..... A43B 7/144 36/25 R
9,144,264 B2 * 9/2015 Marvin ..... A43B 13/186
9,491,985 B2 * 11/2016 Lubart ..... A43B 13/22
2002/0078598 A1 * 6/2002 Bell ..... A43B 13/223 36/59 R
2004/0000075 A1 * 1/2004 Auger ..... A43C 15/162 36/128
2005/0081406 A1 * 4/2005 Hoffer ..... A43B 3/0026 36/59 R
2005/0086838 A1 4/2005 Khantzis
2006/0016100 A1 * 1/2006 Riha ..... A43B 13/223 36/59 R
2007/0199211 A1 * 8/2007 Campbell ..... A43B 5/001 36/59 R
2007/0199213 A1 * 8/2007 Campbell et al. ..... 36/102
2007/0283595 A1 * 12/2007 Bright ..... A43B 3/0052 36/25 R
2007/0283599 A1 12/2007 Talbott
2008/0196277 A1 * 8/2008 Cook ..... A43B 1/0036 36/137
2009/0077830 A1 3/2009 Lee
2009/0188132 A1 * 7/2009 Fujikawa ..... A43B 13/223 36/103
2009/0282700 A1 * 11/2009 Dillon ..... A43B 13/184 36/88
2009/0307932 A1 * 12/2009 Kirby ..... A43B 13/223 36/134
2011/0047832 A1 * 3/2011 O'Mary ..... A43B 13/141 36/25 R
2011/0047834 A1 * 3/2011 Baker ..... A43B 13/223 36/67 A
2011/0167672 A1 * 7/2011 Bond ..... A43B 13/223 36/28
2011/0206886 A1 * 8/2011 Kim ..... C09J 7/0296 428/41.8
2012/0260535 A1 * 10/2012 Tsang ..... A43B 13/26 36/32 R
2013/0067771 A1 3/2013 Minami
2013/0067777 A1 * 3/2013 Minami ..... A43B 13/22 36/59 R
2013/0283641 A1 * 10/2013 Rapf ..... A43B 13/26 36/103
2013/0318828 A1 * 12/2013 Sink ..... A43B 13/14 36/103
2014/0013624 A1 * 1/2014 Stockbridge ..... A43B 13/00 36/103
2015/0181977 A1 * 7/2015 Klug ..... A43B 13/26 36/134
2016/0174659 A1 * 6/2016 Lubart ..... A43B 13/22 36/59 C

OTHER PUBLICATIONS

International Search Report and Written Opinion for Application No. PCT/US2014/052808, mailed on Feb. 3, 2015.
International Preliminary Report on Patentability for Application No. PCT/US2014/052608, mailed on Mar. 15, 2016.

* cited by examiner

OUTSOLE WITH STEPPED PROJECTIONS FOR ARTICLE OF FOOTWEAR

FIELD

The present disclosure relates to footwear and, more particularly, relates to an outsole with stepped projections for an article of footwear.

BACKGROUND

Articles of footwear usually include an upper and a sole structure. Generally, the upper can receive the wearer's foot and secure the footwear to the foot. Also, the sole structure can provide traction for the footwear. Moreover in some embodiments, the sole structure can be resiliently compressible to provide cushioning to the wearer's foot.

More specifically, the upper can include one or more sheet-like sections of material that define a cavity for receiving the wearer's foot. The upper can also include laces, straps, buckles, buttons, and other similar components for securing the footwear to the wearer's foot.

Also, the sole structure can include a midsole in some embodiments. The midsole can include resiliently compressible members, such as foam, a fluid-filled bladder, or other similar members. As such, the midsole can resiliently compress under the weight of the wearer or due to impact with a ground surface. This can help distribute the resulting loads across the sole assembly and/or attenuate the loads to provide cushioning.

The sole structure can additionally include an outsole. The outsole can be made from relatively high friction material such that the outsole can readily grip the ground with firm traction. The outsole can also include grooves, sipes, recesses, or other features that increase surface area of the ground engaging surface, that can channel water away from the ground engaging surface, or otherwise increase such traction for the article of footwear.

SUMMARY

An article of footwear is disclosed that has a medial side and a lateral side. The article of footwear defines a lateral axis that extends between the medial side and the lateral side. The article of footwear includes an upper and a sole structure that is operably coupled to the upper. The sole structure extends along the lateral axis. The sole structure includes an outsole having a base with an upper surface that faces the upper and a lower surface that faces away from the upper surface. The outsole also includes a first stepped projection that projects in a plurality of first steps from the lower surface. In exemplary embodiments; the plurality of first steps can be defined by a plurality of first tread surfaces and a plurality of first riser surfaces. The outsole additionally includes a second stepped projection that projects in a plurality of second steps from the lower surface. In exemplary embodiments, the plurality of second steps can be defined by a plurality of second tread surfaces and a plurality of second riser surfaces. The second stepped projection can be spaced away from the first stepped projection relative to the lateral axis of the article of footwear.

An article of footwear is also disclosed that includes an upper having an interior surface and an exterior surface. The article of footwear also includes a sole structure that is operably coupled to the upper. The sole structure includes an outsole that has a base. The base has an upper surface that faces the upper and a lower surface that faces away from the upper surface. The upper surface can be layered underneath and attached directly to the exterior surface of the upper. The outsole also includes a projection that projects from the lower surface of the base along a first direction. The projection has a transverse dimension measured in a second direction that is transverse to the first direction. The projection decreases in the transverse dimension as the projection projects in the first direction. Additionally, the base and the projection are resiliently flexible and moveable between a neutral position and a flexed position. The interior surface moves due to the movement between the neutral position and the flexed position.

Moreover, an article of footwear is disclosed that includes a forefoot portion, a heel portion, a medial side, and a lateral side. The medial side and the lateral side each extend between the forefoot portion and the heel portion. The article of footwear includes an upper and a sole structure that is operably coupled to the upper. The sole structure has a ground engaging surface and a total thickness. The sole structure includes an outsole with a base with an upper surface that is directly attached to the upper and a lower surface that faces away from the upper. The base can have a base thickness measured between the upper surface and the lower surface. In some embodiments, the base thickness can be at most approximately thirty percent (30%) of the total thickness of the sole structure. Furthermore, the outsole includes a plurality of stepped projections that each project from the lower surface of the base. Each of the plurality of stepped projections can include at least three riser surfaces. The plurality of stepped projections can be arranged in a plurality of rows that extend generally between the medial side and the lateral side. The plurality of stepped projections can also be arranged in a plurality of columns that extend generally between the forefoot portion and the lateral portion. The plurality of stepped projections can be spaced apart from each other within the plurality of rows and within the plurality of columns.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
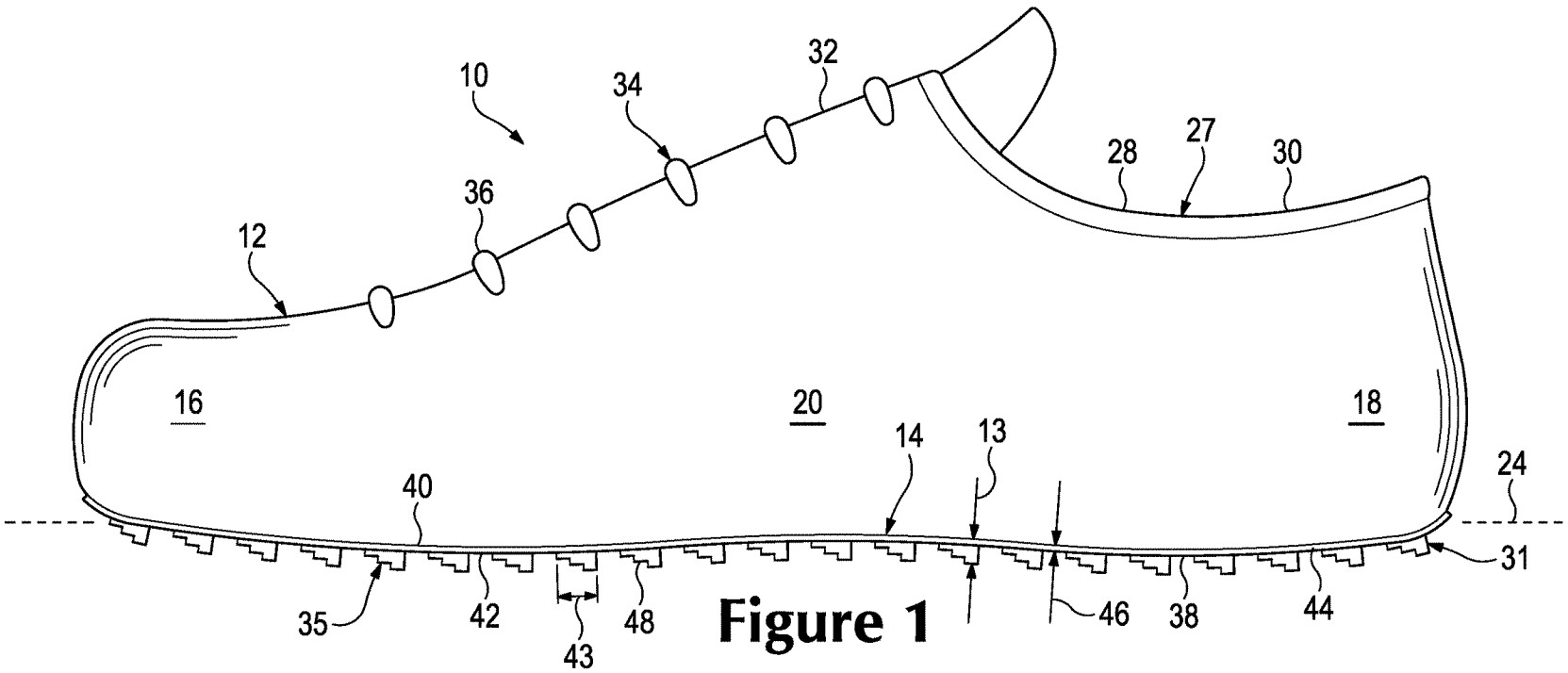
FIG. 1 is a side view of an article of footwear according to an exemplary embodiment of the present disclosure.
Figure 2:
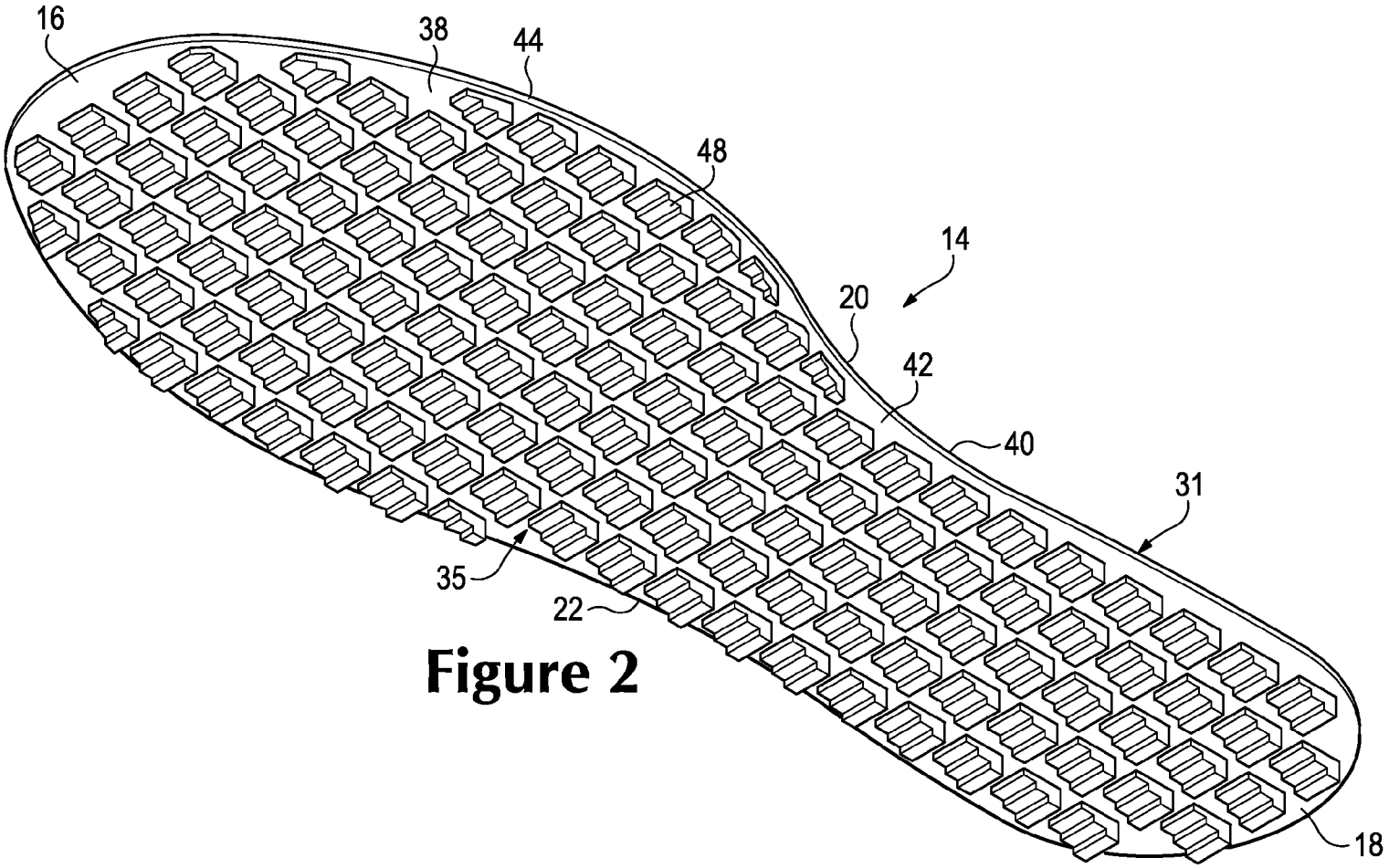
FIG. 2 is a perspective view of a sole structure of the article of footwear of HG. 1.

Referring initially to FIGS. 1 and 2, exemplary embodiments of an article of footwear 10 are illustrated according to various teachings of the present disclosure. Generally, the article of footwear 10 includes an upper 12 and a sole structure 14 that are operably coupled together. Although the article of footwear 10 is illustrated as an athletic shoe, it will be appreciated that the footwear 10 could be a boot, a sandal, or any other type without departing from the scope of the present disclosure.

Footwear 10 can be constructed to include a forefoot portion 16, a heel portion 18, a medial side 20, and a lateral side 22. The medial side 20 and lateral side 22 can both extend between the forefoot portion 16 and the heel portion 18, and the medial side 20 and lateral side 22 can be disposed on opposite sides of a longitudinal axis 24 of the footwear 10. Also, a lateral axis 26 can extend transversely relative to the longitudinal axis 24 and can extend between the medial side 20 and the lateral side 22. For example, the lateral axis 26 can be substantially perpendicular to the longitudinal axis 24. The forefoot portion 16 can support the forefoot area of the wearer's foot, such as the toes, metatarsals, and other neighboring areas of the foot. The heel portion 18 can support the wearer's heel and ankle. The medial side 20 can support the medial side of the wearer's foot, and the lateral side 22 can support the lateral side of the wearer's foot.

Referring now to FIGS. 1 and 2, the upper 12 will be discussed in greater detail according to exemplary embodiments of the present disclosure. In some embodiments, the upper 12 can include one or more sheets of material that is/are shaped to define an internal void 27 that can receive the wearer's foot. The upper 12 can be made from any suitable material. For example, the upper 12 can be at least partially constructed from leather, fabric, or synthetic material. Also, the upper 12 can be made from a mesh material such that the upper 12 is lightweight and air can readily move in and out of the upper 12.

As shown in the illustrated embodiments, the upper 12 can continuously extend between the forefoot portion 16, the heel portion 18, the medial side 20, and the lateral side 22 of the article of footwear 10. Also, the upper 12 can include a collar 28 that defines an ankle opening 30, which provides access into and out of the internal void 27. Additionally, the upper 12 can include a throat opening 32 that extends along the longitudinal axis 24 between the medial side 20 and the lateral side 22. A securing device 34, such as a shoelace 36, can extend across the throat opening 32 to selectively vary the width of the upper 12. For instance, the shoelace 36 can be tightened to make the upper 12 more narrow for securing the upper 12 to the wearer's foot. The shoelace 36 can also be loosened to make the upper 12 wider for releasing the upper 12 from the wearer's foot. It will be appreciated that the shoelace 36 is merely one example of a suitable securing device 34 for the article of footwear 10, and the article of footwear 10 could also include straps, buckles, loop-and-pile tape, elastic bands, or other types of securing devices 34 without departing from the scope of the present disclosure. Also a tongue can be provided within the throat opening 32 to be disposed between the securing device 34 and the wearer's foot in some embodiments.

Figure 4:
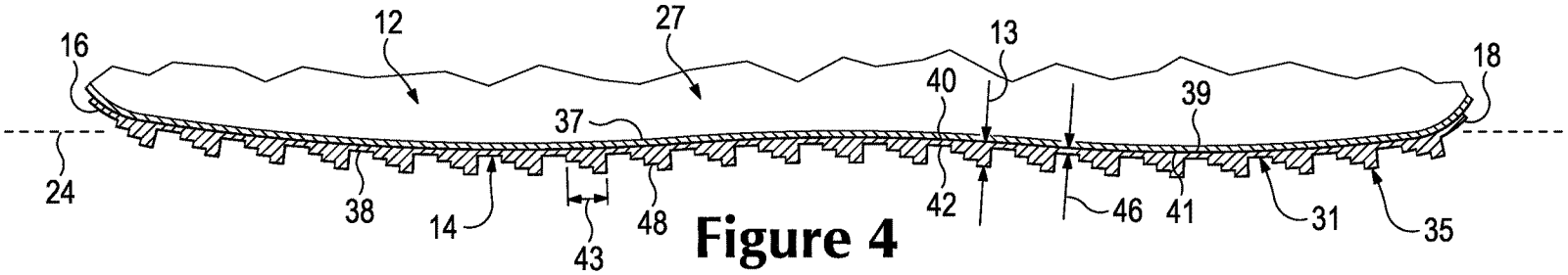
FIG. 4 is a longitudinal section view of the sole structure of the article of footwear taken along line. 4-4 of FIG. 3.

As partially shown in FIG. 4, the upper 12 can additionally include a strobel member 37, which can also be referred to as a "strobel" or as a "strobel sock." Those having ordinary skill in the art will understand that the strobel member 37 can be a sheet of material that extends horizontally and continuously between the forefoot portion 16, the heel portion 18, the medial side 20, and the lateral side 22. As such, the strobel member 37 can be disposed underneath the wearer's foot. Strobel member 37 can include an interior surface 39 and an exterior surface 41. The interior surface 39 can face the sole of the wearer's foot and can abut against the wearer's foot or the stocking enclosing the wearer's foot. The exterior surface 41 can face in an opposite direction from the interior surface 39.

Referring now to FIGS. 1-4, the sole structure 14 will be discussed in greater detail. The sole structure 14 can be attached to the upper 12 and can extend under the wearer's foot. Also, the sole structure 14 can define a ground engaging surface 35 that engages the ground, floor, running track, or other supporting surface. Also, the sole structure 14 can provide increased traction when walking, running, or jumping. Furthermore, the sole structure 14 can be resiliently deformable to attenuate impact forces while walking, running, or jumping. Additionally, the sole structure 14 can resiliently recover from such impact to provide energy return to the wearer's foot.

As shown in the illustrated embodiments, the sole structure 14 can include an outsole 31. The outsole 31 can be connected directly to the upper 12. For example, as shown in FIG. 4, the outsole 31 can be layered underneath and directly attached to the strobel member 37. In other embodiments, the sole structure 14 can include a midsole between the upper 12 and the outsole 31, and the midsole can be made from resilient materials, bladders, or other items that resiliently deform and compress to attenuate impact forces. However, those having ordinary skill in the art will recognize that the article of footwear 10 shown in the illustrated embodiments does not include a midsole. Stated differently, the sole structure 14 of the footwear 10 can be "midsoleless". The outsole 31 can be resiliently deformable to provide at least some of the energy damping and energy return that a traditional midsole provides. It will be appreciated that the absence of a midsole can provide weight savings and can increase manufacturing efficiency for the article of footwear 10. The absence of the midsole can further allow the outsole 31 to transfer loads to the wearer's foot in a direct manner. As such, sole structure 14 can enhance proprioceptive qualities to the wearer and provide other advantages that will be discussed in detail below. Also, the upper 12, the sole structure 14, and/or other aspects of the footwear 10 can incorporate one or more of the features disclosed in U.S. Patent Publication No. 20150068061, to Farris et al., entitled "Article of Footwear With Upper Having Member With Support Arm," (U.S. patent application Ser. No. 14/025,394, which was co-filed with the present application on Sept. 12, 2013) and which is incorporated by reference in its entirety.

Embodiments of the outsole 31 will now be discussed in detail. As will be discussed, the outsole 31 can be thin, flexible, and lightweight. Also, the outsole 31 can include a plurality of projections that project downward and away from the upper 12. The projections can project away from the upper 12 and can reduce in width, length, or other dimension as the projections project from the upper 12 as will be discussed. These projections can increase traction and can resiliently deform to attenuate impact forces when running, walking, jumping, or otherwise moving. The sole structure 14 can also have a high degree of flexibility. For example, the outsole 31 can flex during use in such a way that the outsole 31 provides tactile feedback for the wearer. For example, when the foot impacts the ground, the outsole 31 can flex and deform to transfer at least some impact force to the wearer such that the wearer can "feel" the ground to a higher degree as compared to wearing conventional articles of footwear.

As shown in the embodiments illustrated, the outsole 31 can include a base 38. The base 38 can also be referred to as a "web". The base 38 can be a relatively thin sheet of flexible material that extends continuously between the forefoot portion 16, the heel portion 18, the medial side 20, and the lateral side 22. The base 38 can also include an upper surface 40 and a lower surface 42 that face in opposite directions. The upper surface 40 can face the upper 12, and the lower surface 42 can face away from the upper surface 40 and the upper 12. Moreover, the base 38 can include a peripheral edge 44. The peripheral edge 44 can extend continuously about the article of footwear 10 between the forefoot portion 16, the medial side 20, the heel portion 18, and the lateral side 22. Moreover, the base 38 can have a thickness 46 that is measured between the upper surface 40 and the lower surface 42. In some embodiments, the thickness 46 is constant across the entire base 38, and in other embodiments, the thickness 46 varies across the base 38.

The upper surface 40 of the base 38 can be relatively smooth and can be directly attached to the upper 12. For example, the upper surface 40 can be layered on, can abut, and can be attached to the strobel member 37. In some embodiments, the upper surface 40 can be attached to the strobes member 37 via adhesives. In other embodiments, the base 38 can be attached to the strobel member 37 via stitching, fasteners, or other attachment devices.

Additionally, the outsole 31 can include a plurality of projections 48 that project from the lower surface 42 of the base 38 in a first direction generally away from the upper 12. The first direction can be normal to the lower surface 42 in some embodiments. The first direction can also be disposed at another angle relative to the lower surface 42 in other embodiments. The projections 48 can have any suitable shape. For example, the projections 48 can have a transverse dimension 43 that is transverse to the first direction as shown in FIGS. 1 and 4. In the embodiments shown, the transverse dimension 43 can be considered a width of an individual projection 48. However, the transverse dimension 43 could be a length, circumference, radius, or other dimension in other embodiments. As will be discussed, the transverse dimension 43 here the width of the projection 48 can reduce as the projection 48 projects away from the lower surface 42 in the first direction. For example, as shown in the embodiments of FIGS. 1 and 4, the width of the projection 48 can reduce as the projection 48 projects away from the lower surface 42.

The projections 48 can also be integrally attached to the base 38 such that the projections 48 and base 38 are unitary, monolithic, and form a one-piece structure. In other embodiments, the projections 48 can be removably attached to the base 38.

The projections 48 can be shaped, configured, and arranged on the base 38 such that the projections 48 and base 38 can flex together when subjected to one or more input forces. This flexure can be felt by the wearer to provide the wearer with tactile feedback upon impacting the ground for example.

As stated, each projection 48 can reduce in the transverse dimension 43 as the projection 48 projects away from the lower surface 42. For example, as shown in the illustrated embodiments, the projections 48 can be stepped. Stated differently, the projections 48 can project from the base 38 in a plurality of steps 61 as shown in detail in FIG. 5. As such, the projections 48 decrease in the respective transverse dimension 43 as the projection projects in the plurality of steps 61 along the first direction.

The projections 48 can include any number of steps 61. For example, as shown in the illustrated embodiments, the projections 48 can include at least three steps 61. These steps 61 can include and can be defined by a plurality of riser surfaces and tread surfaces as will be discussed in detail below.

Figure 5:
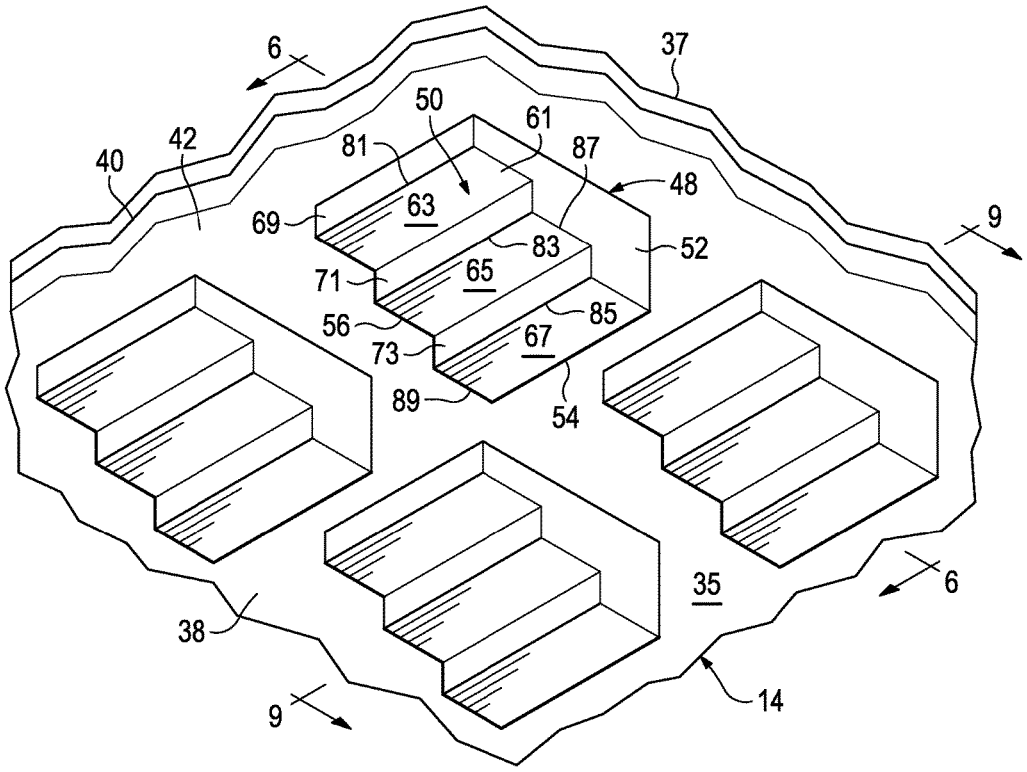
FIG. 5 is a perspective view of a plurality of stepped projections of the sole structure of the article of footwear of FIG. 1.

Referring specifically to FIG. 5, exemplary embodiments of stepped projections 48 will be discussed in detail. Although the stepped projections 48 are substantially similar in the embodiments of FIG. 5, it will be appreciated that the stepped projections 48 of the sole structure 14 could vary in some embodiments.

As shown in FIG. 5, the projections 48 can include a stepped side 50 that is defined by the plurality of steps 61. The projections 48 can also include at least one additional side that projects from the base 38. For example, the projection 48 can include a second side 52, a third side 54, and a fourth side 56. The stepped side 50 projects from the base 38 in the plurality of steps 61, and the second side 52, the third side 54, and the fourth side 56 also project from the base 38. The projections 48 can also include a respective ground engaging surface 67 that extends between the stepped side 50, the second side 52, the third side 54, and the fourth side 56. As will be described, these features can be defined by a plurality of substantially planar surfaces; however, these features can also be defined by contoured surfaces in other embodiments. It will also be appreciated that the projections 48 can have any suitable shape, and the projections 48 can include any number of sides and surfaces.

As shown in the embodiments illustrated in FIG. 5, the stepped side 50 can generally include three steps 61. Stated differently, the stepped side 50 can include at least three riser surfaces, each disposed between respective tread surfaces. In some embodiments, the riser surfaces and tread surfaces can be substantially smooth. These surfaces can also be planar in some embodiments, or these surfaces can be contoured in some embodiments. Moreover, in some embodiments, the riser surfaces can be substantially perpendicular to the tread surfaces, but in additional embodiments, the riser surfaces can be disposed at another angle relative to the tread surfaces.

More specifically, as shown in the embodiments of FIG. 5, the stepped side 50 can be defined by a first riser surface 69, a first tread surface 63, a second riser surface 71, a second tread surface 65, and a third riser surface 73. The first riser surface 69, the first tread surface 63, the second riser surface 71, the second tread surface 65, and the third riser surface 73 can each be substantially planar. The first riser surface 69 can project normally from the lower surface 42 of the base 38. The first tread surface 63 can extend substantially perpendicular to the first riser surface 69. The second riser surface 71 can project normally from the first tread surface 63 and can be substantially parallel to the first riser surface 69. The second tread surface 65 can extend substantially perpendicular to the second riser surface 71 and can be substantially parallel to the first tread surface 63. The third riser surface 73 can project normally from the second tread surface 65 and can be substantially parallel to the second riser surface 71.

The ground engaging surface 67 can extend substantially perpendicular to the third riser surface 73 and can be substantially parallel to the first tread surface 63 and the second tread surface 65. Because of its similarity to the first tread surface 63 and the second tread surface 65, the ground engaging surface 67 could be referred to as a "third tread surface" of the plurality of steps 61. However, for purposes of discussion, this surface will be referred to as the ground engaging surface 67.

Thus, the first tread surface 63 can be spaced away from the lower surface 42 of the base 38 by the first riser surface 69. Also, the second tread surface 65 can be spaced away from the first tread surface 63 by the second riser surface 71. Moreover, the ground engaging surface 67 can be spaced way from the second tread surface 65 by the third riser surface 73.

Additionally, the first riser surface 69 and the first tread surface 63 can intersect at a first edge 81. Likewise, the second riser surface 71 and the second tread surface 65 can intersect at a second edge 83. Furthermore, the third riser surface 73 and the ground engaging surface 67 can intersect at a third edge 85.

As shown in FIG. 5, the second side 52 and the fourth side 56 can each be substantially smooth and planar surfaces that extend transversely from opposite sides of the stepped side 50. Moreover, the third side 54 can be substantially smooth and planar, and the third side 54 can extend between the second side 52 and the fourth side 56. The second side 52 and the fourth side 56 can be substantially parallel to each other, and the third side 54 can be substantially perpendicular to the second side 52 and the fourth side 56. The second side 52 can intersect the plurality of steps 61 at a second stepped edge 87, and the fourth side 56 can intersect the plurality of steps 61 at a fourth stepped edge 89.

Figure 3:
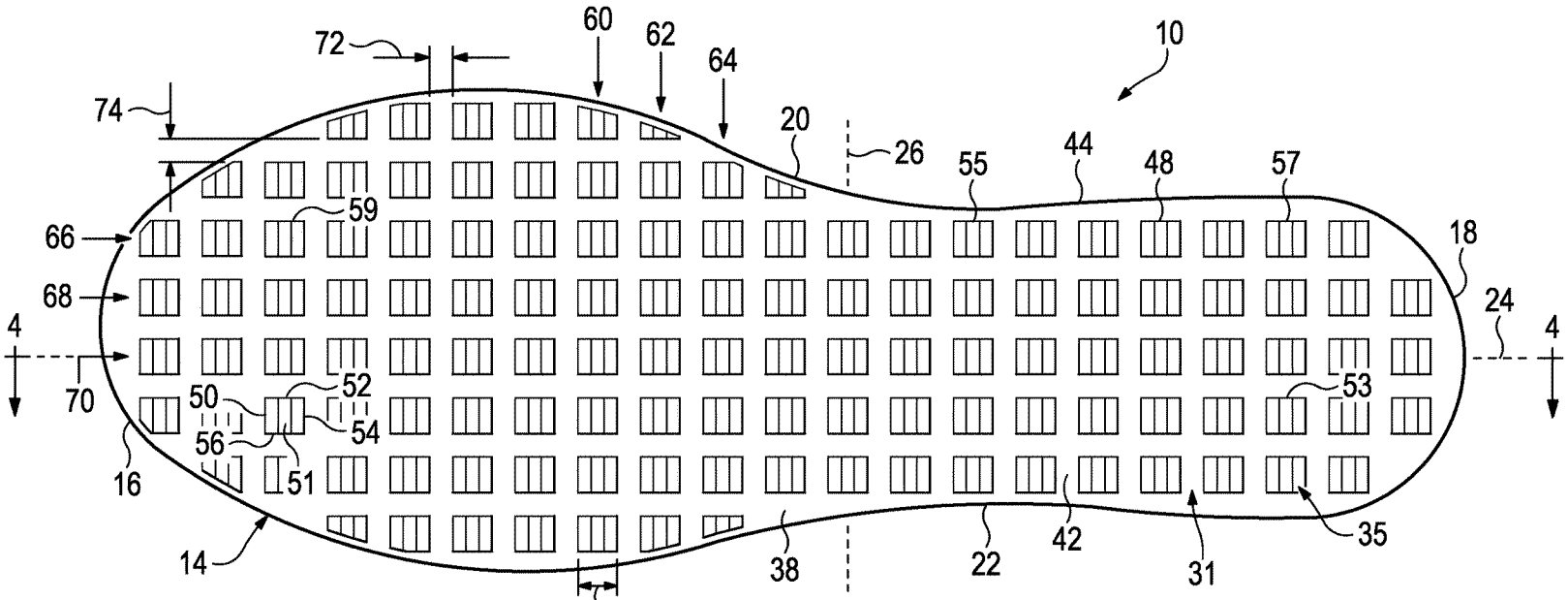
FIG. 3 is a bottom view of the article of footwear of FIG. 1.

Referring now to FIGS. 2 and 3, the arrangement of the plurality of projections 48 on the outsole 31 will now be discussed. It will be appreciated that the projections 48 can be arranged in any suitable fashion.

For example, as shown in FIG. 3, the projections 48 can be disposed such that the stepped side 50 of the projections 48 generally face the forefoot portion 16 of the article of footwear 10, the second side 52 faces the medial side 20, the third side 54 faces the heel portion 18, and the fourth side 56 faces the lateral side 22. In some embodiments, the second side 52 and the fourth side 56 can be substantially parallel to the longitudinal axis 24, and the third side 54 can be substantially parallel to the lateral axis 22.

Additionally, the projections 48 can be spaced apart from each other and arranged in any suitable pattern on the base 38 of the outsole 31. For example, as shown in FIG. 3, the projections 48 can be spaced apart from each other in the longitudinal direction and in the transverse direction. More specifically, neighboring projections 48 can be spaced apart by a longitudinal distance 72, which is measured substantially parallel to the longitudinal axis 24, and neighboring projections 48 can also be spaced apart by a transverse distance 74, which is measured substantially parallel to the lateral axis 26. As shown, the longitudinal distance 72 between neighboring projections 48 can be equal across the outsole 31, and the transverse distance 74 between neighboring projections 48 can also be equal across the outsole 31.

Furthermore, as shown in FIG. 3, the projections 48 can be aligned and arranged in respective rows that extend generally between the medial side 20 and the lateral side 22 of the article of footwear 10. A representative first row 60, second row 62, and third row 64 are indicated in FIG. 3, and as shown, the rows of projections 48 can be substantially parallel to the lateral axis 26.

Also, as shown in FIG. 3, the projections 48 can be aligned and arranged in respective columns that extend generally between the forefoot portion 16 and the heel portion 18 of the article of footwear 10. A representative first column 66, second column 68, and third column 70 are indicated in FIG. 3, and as shown, the columns of projections 48 can be substantially parallel to the longitudinal axis 24.

For purposes of discussion, a first stepped projection 51, a second stepped projection 53, a third stepped projection 55, a fourth stepped projection 57, and a fifth stepped projection 59 are indicated in FIG. 3. As shown, the first stepped projection 51 and the second stepped projection 53 can be disposed in a common column. Meanwhile, the third stepped projection 55, the fourth stepped projection 57, and the fifth stepped projection 59 can be disposed in a common column. Also, the first stepped projection 51 and the fifth stepped projection 59 can be disposed in a common row while the second stepped projection 53 and the fourth stepped projection 57 can be disposed in a common row.

It will be appreciated that the outsole 31 can be made from any suitable material. For example, the outsole 31 can be made from rubber or thermoplastic polyurethane in some embodiments. Also, the outsole 31 can be manufactured using suitable means, such as injection molding processes. Once formed, the outsole 31 can be attached to the upper 12 using adhesives, stitching, fasteners, or other attachment devices. In additional embodiments, the outsole 31 can be formed by injection molding and, the outsole 31 can be simultaneously attached to the upper 12 during the same injection molding process. More specifically, the upper 12 can be fit to a foot-shaped last, the upper 12 can be partially inserted inside a mold cavity, and molten material of the outsole 31 can then be introduced into the mold cavity. The material can cure inside the mold cavity to form the shape of the outsole 31 and to also attach to the upper 12. In still additional embodiments, the outsole 31 can be removably attached to the upper 12. For example, the outsole. 31 can attach to the upper 12 as disclosed in U.S. Pat. No. 7,543,399 to Kilgore et al., which issued on Jun. 9, 2009, and which is incorporated by reference in its entirety. Also, in this embodiment, the upper 12 can be supplied to a wearer with multiple different outsoles 31, and the wearer can select which of the outsoles 31 to attach to the upper. These outsoles 31 can vary in color, shape, dimension, or in any other characteristic.

In some embodiments, the outsole 31 can resiliently flexible. This can be due to the material used to make the outsole 31 as well as the shape, arrangement, and spacing of the plurality of projections 48. Moreover, the thickness 46 of the base 38 can be relatively low to enhance the flexibility of the outsole 31.

Furthermore, as discussed above, the projections 48 can be spaced apart along the lateral axis 26. As such, the projections 48 can individually or collectively flex relative to the base 38 toward the medial side 20 and/or toward the lateral side 22. The projections 48 can be also spaced along the longitudinal axis 24. As such, the projections 48 individually or collectively flex toward the forefoot portion 16 and the heel portion 18 as will be discussed in detail below.

Figure 6:
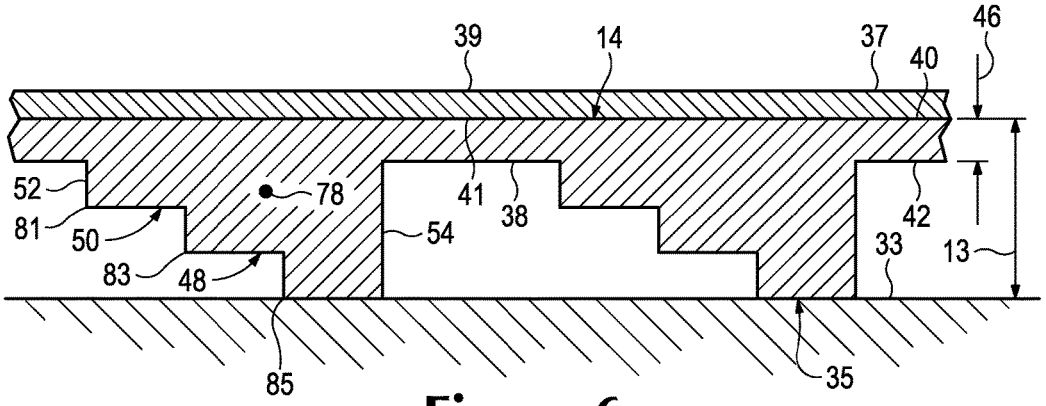
FIG. 6 is a section view of the sole structure taken along the line 6-6 of FIG. 5.
Figure 9:
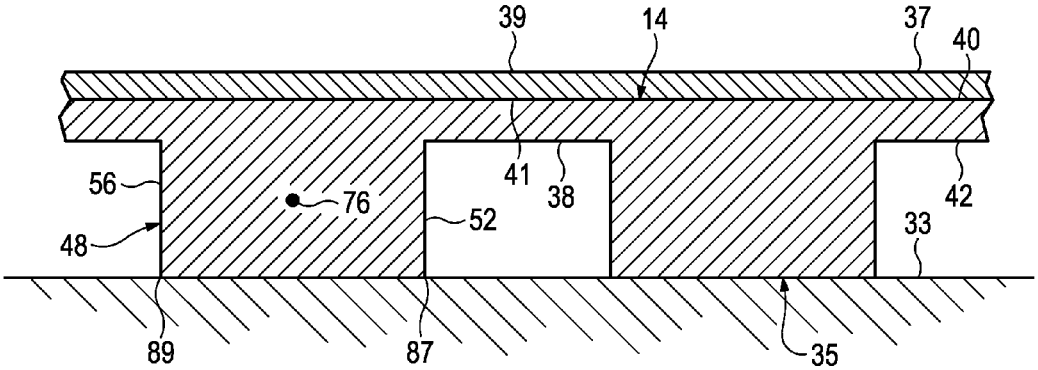
FIG. 9 is a section view of the sole structure taken along the line 9-9 of FIG. 5.

For example, the outsole 31 can be at rest in a neutral position shown in FIGS. 1, 3-6, and 9. The outsole 31 can be disposed in this neutral position when not under the influence of an external input load. In this neutral position, the plurality of projections 48 can be shaped as discussed above, with respective surfaces being generally planar. Also, first tread surface 63, second tread surface 65, and ground engaging surface 67 can be substantially parallel to the surrounding base 38 as shown in FIGS. 6 and 9. Also, the base 38 of the outsole 31 can be substantially smooth and substantially parallel to the ground 33 when in this neutral position.

However, the projections 48 and/or the base 38 can resiliently flex away from the neutral position under the influence of an external load. Specifically, when the footwear 10 impacts the ground 33 during running, walking, or jumping, the projections 48 and/or base 38 can resiliently flex away from the neutral position shown in FIGS. 1, 3, 4, 5, and 6.

Figure 7:
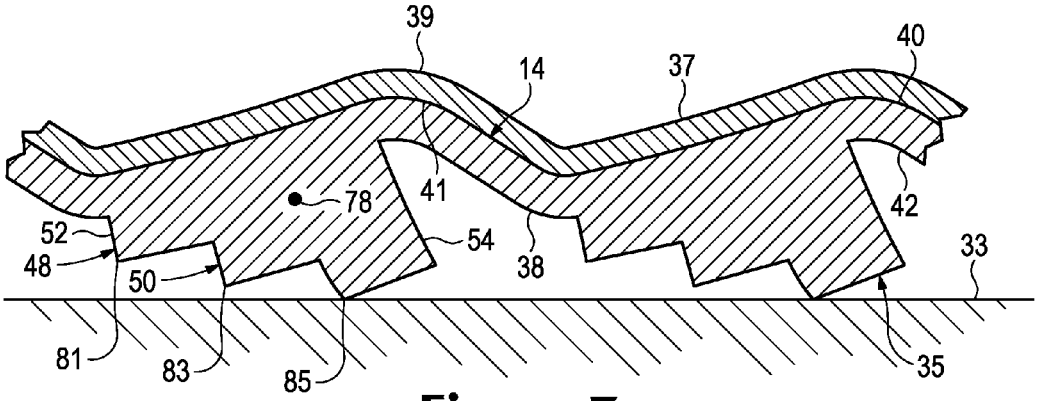
FIG. 7 is a section view of the sole structure of FIG. 6 shown in a first flexed position.
Figure 8:
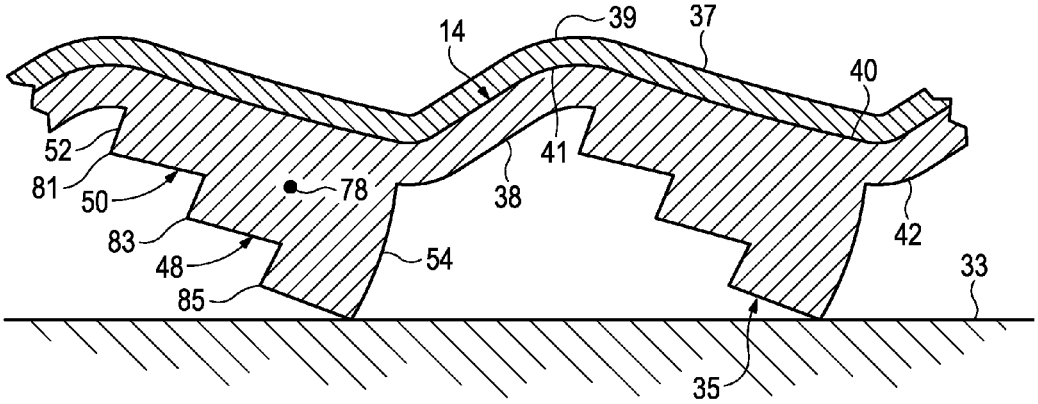
FIG. 8 is a section view of the sole structure of FIG. 6 shown in a second flexed position.

For example, as shown in FIG. 7, the projections 48 can deform, resiliently flex, bend, and/or rotate about a transverse bending axis 78 into a first flexed position. It will be appreciated that transverse bending axis 78 can extend between the medial side 20 and the lateral side 22 of the footwear 10 as shown in FIG. 7. Specifically, the projections 48 can bend and rotate in a rearward or substantially counterclockwise direction about the bending axis 78. This flexure can occur, for example, when the outsole 31 impacts the ground 33 with forward momentum. As shown, the projections 48 can deform such that one or more surfaces can become contoured. Also, at least one of the first edge 81, the second edge 83, and the third edge 85 can contact the ground 33. In contrast, as shown in FIG. 8, the projections 48 can also deform, resiliently flex, bend, and/or rotate in the opposite direction about the bending axis 78. This flexure can occur, for example, when the outsole 31 impacts the ground 33 with rearward momentum.

Figure 10:
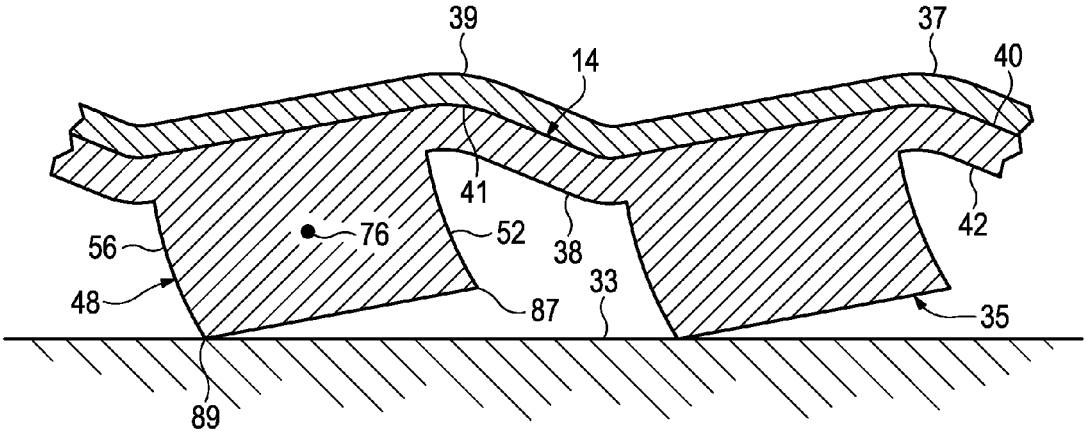
FIG. 10 is a section view of the sole structure of FIG. 9 shown in a first flexed position.
Figure 11:
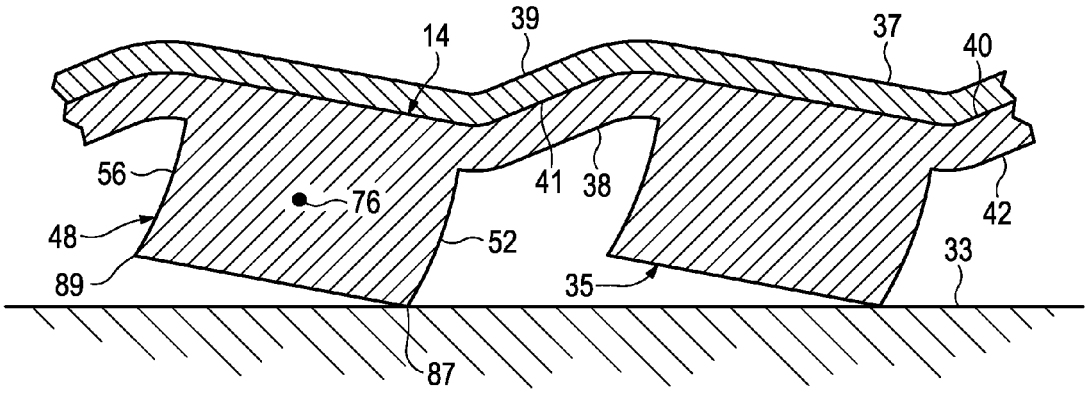
FIG. 11 is a section view of the sole structure of FIG. 9 shown in a second flexed position.

Still further, as shown in FIG. 10, the projections 48 can deform, resiliently flex, bend, and/or rotate in a counterclockwise direction about a longitudinal bending axis 76. It will be appreciated that the longitudinal bending axis 76 can extend between the forefoot portion 16 and the heel portion 18 of the footwear 10. This can occur, for example, when the outsole 31 impacts the ground 33 with laterally-directed momentum. In contrast, as shown in FIG. 11, the projections 48 can deform, resiliently flex, bend, and/or rotate in the opposite direction about the axis 76. This can occur, for example, when the outsole 31 impacts the ground 33 with medially-directed momentum. As shown in FIGS. 10 and 11, transverse flexure of the projections 48 can cause the second side 52 and fourth side 56 to become contoured, and the projections 48 can flex such that the projections 48 become supported on the ground 33 by the second stepped edge 87 or the fourth stepped edge 89.

The thickness of the base 38 can be relatively low for enhancing this flexibility of the outsole 31. For example, in some embodiments, the thickness 46 of the base 38 can be at most thirty percent (30%) of a total thickness 13 of the outsole 31. In some further embodiments, the thickness 46 of the base 38 can be at most twenty-five percent (25%) of a total thickness 13 of the outsole 31. Also, the thickness 46 of the base 38 can measure at most approximately 1.5 millimeters in some embodiments. This low thickness 46 of the base 38 can allow the base 38 and the projections 48 to flex together in concert when impacting the ground 33.

For example, the base 38 can be substantially smooth in the neutral, unloaded position of FIGS. 6 and 9. However, the base 38 can flex with the projections 48 as shown in FIGS. 7, 8, 10, and 11 due to impact with the ground 33. Specifically, the areas of the base 38 between the projections 48 can flex such that the base 38 becomes contoured and wavy as shown in the illustrated embodiments. The base 38 can, therefore, push upwards on the strobel member 37 and move the strobel member 37 causing the upper surface 39 of the strobel member 37 to push upward on the wearer's foot. It will be appreciated that the amount of flexure and/or waviness of the base 38 shown in FIGS. 7, 8, 10, and 11 is an example, and that this amount of waviness can vary depending on the dimensions of the base 38, the weight of the wearer pressing down on the base 38, or other factors. Also, in some embodiments, the base 38 can remain substantially smooth during flexure of the outsole 31.

Once the outsole 31 is unloaded, the base 38 and the projections 48 can resiliently return to the neutral position shown in FIGS. 1, 3-6, and 9. As a result, the strobel member 37 can also return to a relatively smooth configuration. This flexure and recovery of outsole 31 and strobel member 37 can be repeated as the wearer runs, walks, jumps or during other ambulatory activities.

Additionally, this flexure of the outsole 31 can cause the outsole 31 to absorb and ameliorate impact loads. This can increase comfort and support for the wearer. The recovery of the outsole 31 can additionally provide energy return to the wearer in some embodiments.

Also, in some embodiments, the flexure and deformation of the projections 48, the base 38 of the outsole 31, and/or the strobel member 37 of the upper 12 can be felt by the wearer of the article of footwear 10. The wearer is likely to feel this flexure and deformation in embodiments where the outsole 31 is attached directly to the upper 12 without a midsole.

For example, when the base 38 flexes from its smooth configuration to its wavy configuration shown in FIGS. 7, 8, 10, and 11, the outsole 31 can press upward onto the exterior surface 41 of the strobel member 37, causing the strobe/member 37 to become wavy and press upwards on the wearer's foot. Forces on the projections 48 can also transfer to the base 38 to increase waviness in the base 38, thereby creating pressure points on the wearer's foot. This can provide a pleasurable, massaging sensation to the wearer in some embodiments. This can also provide a proprioceptive signal to the wearer in some embodiments, for example, facilitating the wearer's ability to "feel" the position of the foot in relation to the ground 33. Moreover, as the footwear 10 first impacts the ground 33, the resulting tactile sensation can prepare the wearer for the full impact load, and the wearer can more efficiently flex foot and leg muscles to absorb the loading and prepare for the next step, stride, or forward thrust.

Furthermore, the plurality of the steps 61 on the projections 48 can allow the projections 48 to flex in a desirable manner. For example, as shown in FIGS. 7 and 8, the steps 61 can allow the projection 48 to flex readily in one direction about the transverse bending axis 78, and the projection 48 can be stiffer in the opposite direction. However, as shown in FIGS. 10 and 11, the steps 61 can allow the projection 48 to have substantially the same stiffness in both directions about the longitudinal bending axis 78. Accordingly, the outsole 31 can be configured to have a primary mode of flexure that provides the wearer with especially effective cushioning, proprioceptive qualities, and the like.

Additionally, the plurality of steps 61 can allow the projections 48 to flex without losing traction. More specifically, as shown in FIG. 7, the projections 48 can flex such that the projection 48 becomes substantially supported on the ground 33 by at least one of the first edge 81, the second edge 83, and the third edge 85. In the embodiments illustrated, these edges can provide lines of contact where pressure can concentrate and help increase traction.

Figure 12:
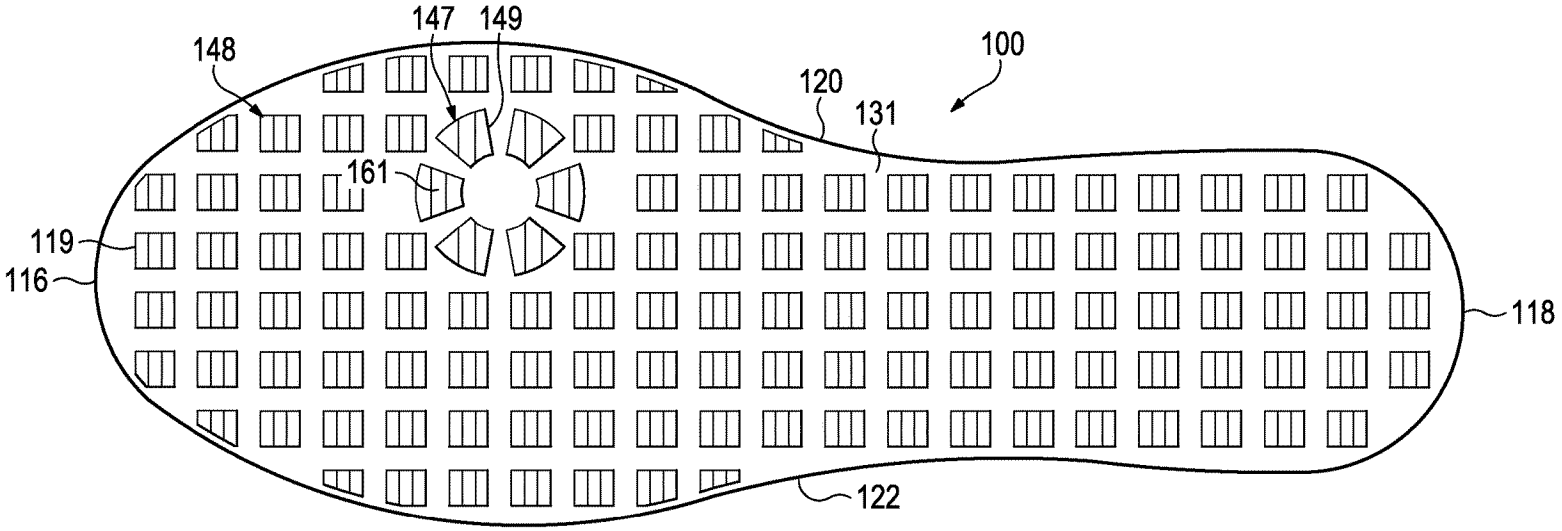
FIG. 12 is a bottom view of the article of footwear with stepped projections according to additional embodiments of the present disclosure.
Figure 13:
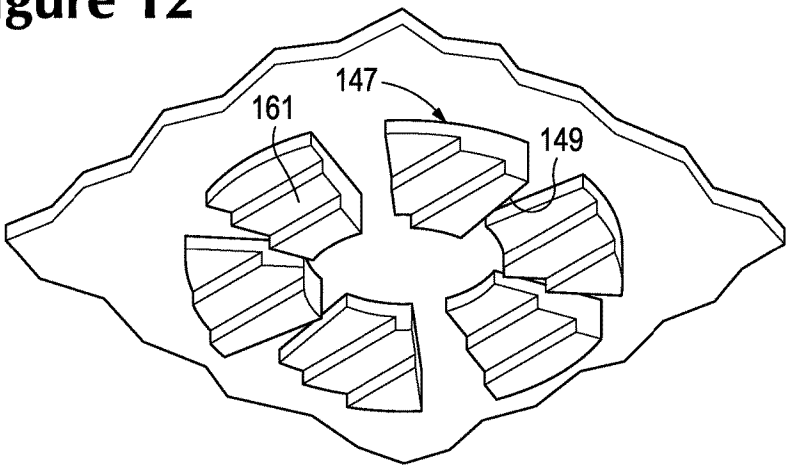
FIG. 13 is a perspective view of stepped projections of the article of footwear of FIG. 12.

Referring now to FIGS. 12 and 13, additional embodiments of the article of footwear 100 are illustrated according to the present disclosure. The footwear 100 can share some common features with the embodiments shown in FIGS. 1-11. For purposes of brevity, the common features will not be repeated with respect to FIGS. 12 and 13. However, features that are unique to the embodiments of FIGS. 12 and 13 will be described in detail.

As shown, the article of footwear 100 can include a plurality of stepped projections 148. The stepped projections 148 can include a plurality of first projections 119 that are arranged in respective rows that extend between the medial side 120 and lateral side 122, similar to the embodiments of FIGS. 1-11. The first projections 119 can also be arranged in respective columns that extend between the forefoot portion 116 and the heel portion 118, similar to the embodiments of FIGS. 1-11.

Moreover, the article of footwear 100 can also include a plurality of second stepped projections 149. The plurality of second stepped projections 149 can be wedge-shaped and can be arranged in a ring 147 on the outsole 131. In some embodiments, the ring 147 can be disposed on the outsole 131 so as to be located underneath the ball of the wearer's foot, for example, underneath the metatarsal of the wearer's big toe. Also, neighboring secondary stepped projections 149 can be spaced apart within the ring 147.

It is noted that, in the embodiments of FIGS. 12 and 13, each of the plurality of steps 161 generally face the forefoot portion 116 of the footwear 100. Accordingly, the steps 161 can provide the advantages discussed above with respect to the embodiments of FIGS. 12 and 13. Also, because the secondary stepped projections 149 are arranged in the ring 147, the secondary stepped projections 149 can provide comfort, proprioceptive signals, or otherwise support for the ball of the wearer's foot. This can be effective because this area of the wearer's foot can experience a high degree of loading during walking, running, jumping, and other ambulatory activities.

The foregoing description of the embodiments has been provided for purposes of illustration and description. It is not intended to be exhaustive or to limit the present disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present disclosure, and all such modifications are intended to be included within the scope of the present disclosure.

What is claimed is:

1. An article of footwear having a medial side and a lateral side, the article of footwear defining a lateral axis that extends between the medial side and the lateral side, the article of footwear configured to receive a foot, the article of footwear comprising:

an upper defining a cavity configured to receive the foot, the upper having an underfoot portion that is configured to extend underneath the foot, the underfoot portion including a first surface and a second surface, the first surface facing the cavity, the second surface facing opposite the first surface; and a sole structure that is operably coupled to the upper, the sole structure extending along the lateral axis, the sole structure including an outsole that includes:

a base with an upper surface that faces the upper and a lower surface that faces away from the upper surface, a first stepped projection that projects in a plurality of first steps from the lower surface, the plurality of first steps defined by a plurality of first tread surfaces and a plurality of first riser surfaces, and a second stepped projection that projects in a plurality of second steps from the lower surface, the plurality of second steps defined by a plurality of second tread surfaces and a plurality of second riser surfaces, the second stepped projection being spaced away from the first stepped projection relative to the lateral axis of the article of footwear, the base, the first stepped projection, and the second stepped projection being resiliently flexible, the first and second stepped projection configured to flex relative to the base in a lateral direction that extends between the medial side and the lateral side, the first and second stepped projection configured to flex relative to the base in a longitudinal direction that extends between a forefoot portion and a heel portion of the sole structure, the sole structure being resiliently flexible and moveable between a neutral position and a flexed position, the sole structure configured to move the first surface of the underfoot portion of the upper between a smooth position and a wavy position due to movement between the neutral position and the flexed position, the first surface being in the smooth position when the sole structure is in the neutral position, the first surface being in the wavy position when the sole structure is in the flexed position, the upper surface of the base being substantially smooth in the neutral position, the outsole having a ground engaging surface, wherein the outsole has a total thickness measured between the upper surface and the ground engaging surface, and wherein the base has a base thickness measured between the upper surface and the lower surface, the base thickness being at most 30% of the total thickness of the outsole.

2. The article of footwear of claim 1, wherein the first stepped projection and second stepped projection are arranged in a row, wherein the row extends from the medial side to the lateral side.

3. The article of footwear of claim 2, wherein the row is substantially parallel to the lateral axis.

4. The article of footwear of claim 1, wherein the plurality of first steps includes at least three first riser surfaces and the plurality of second steps includes at least three second riser surfaces.

5. The article of footwear of claim 1, wherein the first stepped projection and the second stepped projection are arranged in one of a plurality of rows of stepped projections, the plurality of rows of stepped projections each extending from the medial side to the lateral side, and wherein the first stepped projection and the second stepped projection are arranged in different ones of a plurality of columns of stepped projections, the plurality of columns of stepped projections each extending from the forefoot portion to the heel portion of the article of footwear.

6. The article of footwear of claim 1, wherein the first stepped projection also includes at least one side that projects from the lower surface and that intersects the plurality of first steps at a stepped edge.

7. The article of footwear of claim 6, wherein the at least one side includes a first side and a second side, wherein the first side intersects the plurality of first steps at a first stepped edge, wherein the second side intersects the plurality of first steps at a second stepped edge, and wherein the first stepped projection also includes a third side that extends between the first side and the second side.

8. The article of footwear of claim 7, wherein the first side and the second side are substantially parallel, and wherein the third side is substantially perpendicular to the first side and the second side.

9. The article of footwear of claim 1, wherein the plurality of first steps and the plurality of second steps generally face the forefoot portion and away from the heel portion.

10. The article of footwear of claim 1, wherein each of the plurality of first riser surfaces extends substantially normal to the lower surface, the plurality of first tread surfaces extending transverse to the plurality of first riser surfaces.

11. The article of footwear of claim 1, wherein the underfoot portion of the upper is a strobe member;

wherein the base, the first stepped projection, and the second stepped projection cooperate to define the outsole;

wherein the sole structure is midsole-less; and wherein the outsole is directly attached to the strobe member.

12. The article of footwear of claim 1, wherein the sole structure further includes a plurality of secondary stepped projections, each of the plurality of secondary stepped projections projecting from the base, the plurality of secondary stepped projections being arranged in a ring, a space defined between neighboring ones of the plurality of secondary stepped projections within the ring.

13. An article of footwear having a medial side, a lateral side, a forefoot portion, and a heel portion, the article of footwear comprising:

an upper having an interior surface and an exterior surface; and a sole structure that is midsole-less, the sole structure comprising an outsole that is directly attached to the upper, the outsole including:

a base having an upper surface that faces the upper and a lower surface that faces away from the upper surface, the upper surface being layered underneath and attached directly to the exterior surface of the upper, a projection that projects from the lower surface of the base along a first direction, the projection having a transverse dimension measured in a second direction that is transverse to the first direction, wherein the projection decreases in the transverse dimension as the projection projects in the first direction, the base and the projection being resiliently flexible, the projection configured to flex relative to the base in a lateral direction that extends between the medial side and the lateral side, the projection configured to flex relative to the base in a longitudinal direction that extends between the forefoot portion and the heel portion, the outsole being resiliently flexible and moveable between a neutral position and a flexed position, the outsole configured to move the interior surface of the upper between a smooth position and a wavy position due to movement between the neutral position and the flexed position, the interior surface being in the smooth position when the outsole is in the neutral position, the interior surface being in the wavy position when the outsole is in the flexed position, the upper surface of the base being substantially smooth in the neutral position, wherein the outsole has a ground engaging surface, wherein the base has a base thickness measured between the upper surface and the lower surface, wherein the outsole has a total thickness measured between the upper surface and the ground engaging surface, and wherein the base thickness is at most 30% of the total thickness of the outsole.

14. The article of footwear of claim 13, wherein the projection projects from the lower surface of the base in a plurality of steps along the first direction, and wherein the projection decreases in the transverse dimension as the projection projects in the plurality of steps along the first direction.

15. The article of footwear of claim 14, wherein the plurality of steps include a plurality of tread surfaces and at least three riser surfaces.

16. The article of footwear of claim 15, wherein the at least three riser surfaces face the forefoot portion.

17. The article of footwear of claim 15, wherein the at least three riser surfaces each extends substantially normal to the lower surface, the plurality of tread surfaces extending transverse to the at least three riser surfaces.

18. An article of footwear having a forefoot portion, a heel portion, a medial side, and a lateral side, the medial side and the lateral side each extending between the forefoot portion and the heel portion, the article of footwear configured to receive a foot, the article of footwear comprising:

an upper having an underfoot portion that is configured to extend underneath the foot; and a sole structure that is midsole-less, the sole structure comprising an outsole that is directly attached to the upper, the outsole having a ground engaging surface, the outsole having a total thickness, the outsole including:

a base with an upper surface that is directly attached to the upper and a lower surface that faces away from the upper, the base having a base thickness measured between the upper surface and the lower surface, wherein the total thickness of the outsole is measured between the upper surface and the ground engaging surface, and wherein the base thickness is at most 30% of the total thickness of the outsole, and a plurality of stepped projections that each project from the lower surface of the base, each of the plurality of stepped projections including at least three riser surfaces, the plurality of stepped projections arranged in a plurality of rows that extend from the medial side to the lateral side, the plurality of stepped projections also arranged in a plurality of columns that extend from the forefoot portion to the heel portion, the plurality of stepped projections being spaced apart from each other within the plurality of rows and within the plurality of columns;

the base and the projections being resiliently flexible, the projections configured to flex relative to the base in a lateral direction that extends between the medial side and the lateral side, the projections configured to flex relative to the base in a longitudinal direction that extends between the forefoot portion and the heel portion, the outsole being resiliently flexible and moveable between a neutral position and a flexed position, the outsole configured to move the underfoot portion of the upper between a smooth position and a wavy position due to movement between the neutral position and the flexed position, the underfoot portion being in the smooth position when the outsole is in the neutral position, the underfoot portion being in the wavy position when the outsole is in the flexed position, the upper surface of the base being substantially smooth in the neutral position.

19. The article of footwear of claim 18, wherein at least one of the plurality of stepped projections includes a plurality of steps and at least one side, the at least one side intersecting the plurality of steps at a stepped edge.

20. The article of footwear of claim 19, wherein the at least one side includes a first side and a second side, wherein the first side intersects the plurality of steps at a first stepped edge, wherein the second side intersects the plurality of steps at a second stepped edge, and wherein the at least one of the plurality of stepped projections also includes a third side that extends between the first side and the second side.

21. The article of footwear of claim 20, wherein the first side and the second side are substantially parallel, and wherein the third side is substantially perpendicular to the first side and the second side.

22. The article of footwear of claim 18, wherein the at least three riser surfaces face the forefoot portion and face away from the heel portion.

23. The article of footwear of claim 18, wherein the plurality of stepped projections are substantially equally spaced apart from each other within the plurality of rows and within the plurality of columns.

24. The article of footwear of claim 18, wherein the base thickness is at most 1.5 millimeters.

* * * * *